United States Patent [19]

Olsen

[11] Patent Number: 4,664,230

[45] Date of Patent: May 12, 1987

[54] ELEVATOR

[76] Inventor: Lawrence O. Olsen, 3993 S. Kenthorpe Way, West Linn, Oreg. 97068

[21] Appl. No.: 592,572

[22] Filed: Mar. 23, 1984

[51] Int. Cl.[4] ..... B66B 1/00

[52] U.S. Cl. ..... 187/39; 187/94; 187/95

[58] Field of Search ..... 187/2, 6, 20, 94, 95, 187/88, 77, 73, 78, 38, 39; 52/710; 248/638; 192/0.084; 318/6, 689, 648, 652; 188/188, 189

[56] References Cited

U.S. PATENT DOCUMENTS

| | | | |
|---|---|---|---|
| 1,073,700 | 9/1913 | Neenan | 187/20 |
| 1,270,716 | 6/1918 | Flannery | 187/71 |
| 1,566,491 | 12/1925 | Lindquist | 187/94 |
| 1,702,783 | 2/1929 | Kiesling | 187/95 |
| 1,814,610 | 7/1931 | Stevelman | 187/94 |
| 1,924,320 | 8/1933 | James | 187/39 |
| 2,345,650 | 4/1944 | Attwood | 52/710 |
| 2,964,272 | 12/1960 | Olson | 248/638 |
| 3,039,725 | 6/1962 | Kerley, Jr. | 248/638 |
| 3,249,179 | 5/1966 | Borgman | 187/88 |
| 3,845,842 | 11/1974 | Johnson | 187/71 |
| 3,880,258 | 4/1975 | Rompa | 187/94 |
| 4,488,844 | 12/1984 | Baubles | 52/710 |

FOREIGN PATENT DOCUMENTS

| | | | |
|---|---|---|---|
| 763,771 | 7/1967 | Canada | 187/94 |
| 423148 | 10/1966 | Switzerland | 187/94 |

*Primary Examiner*—Joseph J. Rolla
*Assistant Examiner*—Kenneth Noland
*Attorney, Agent, or Firm*—Robert L. Harrington

[57] ABSTRACT

A convenience elevator that encompasses dumbwaiter and residential elevator applications wherein the entire elevator assembly is mounted to a wall of the elevator shaft. The elevator carriage is provided with sliding guides of high strength low friction polymer that slide in channels provided in vertical guide rails. A guide line fixes the relative position of the carriage and counter weight and a separate drive line controlably drives the carriage up and down in the shaft. Safety switches and brakes provide for efficient operation and the entire structure is designed for economical installation and operation.

6 Claims, 9 Drawing Figures

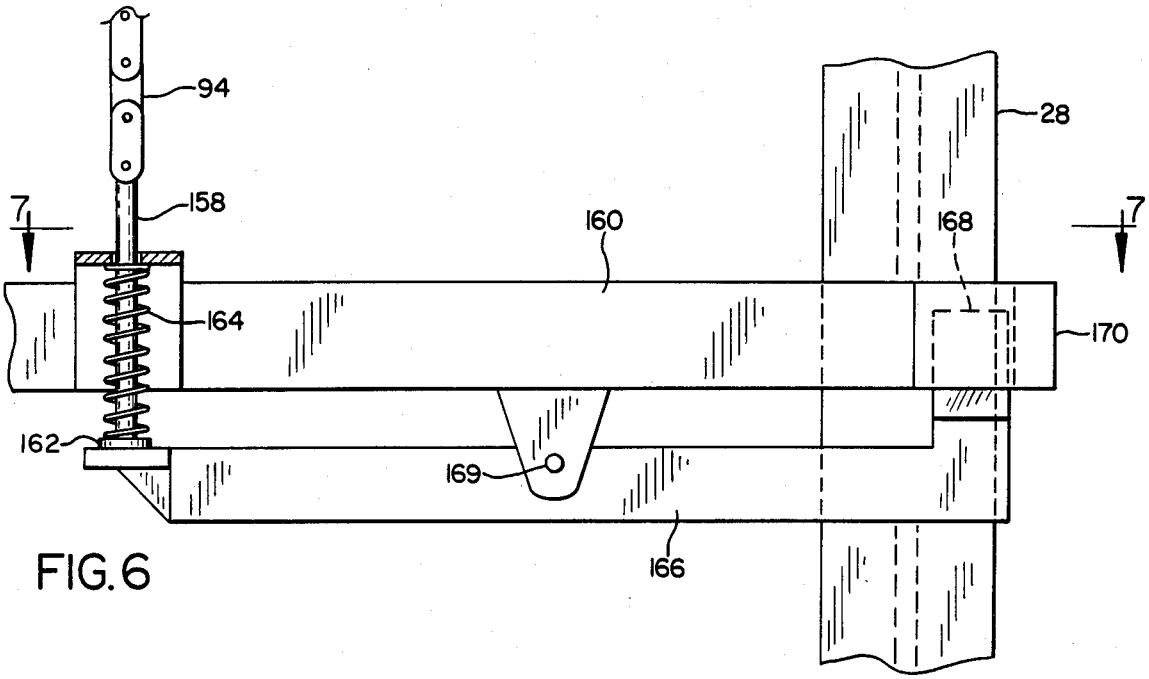
FIG. 6
FIG. 7
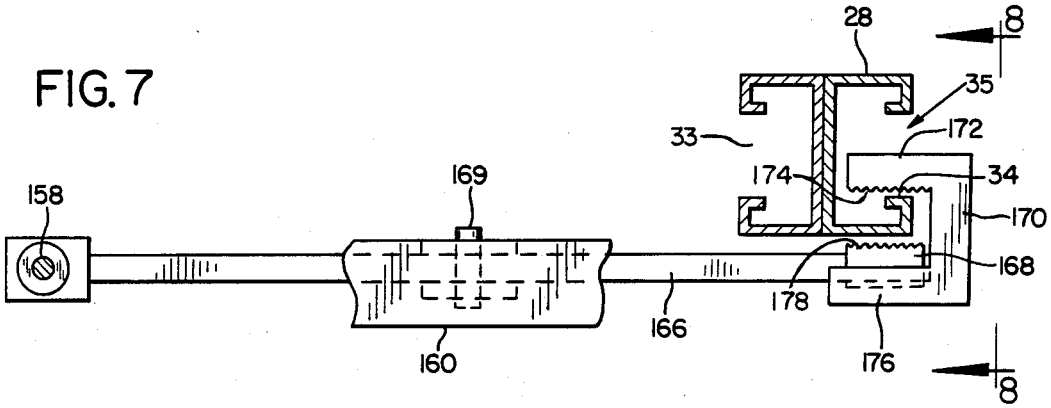
FIG. 8
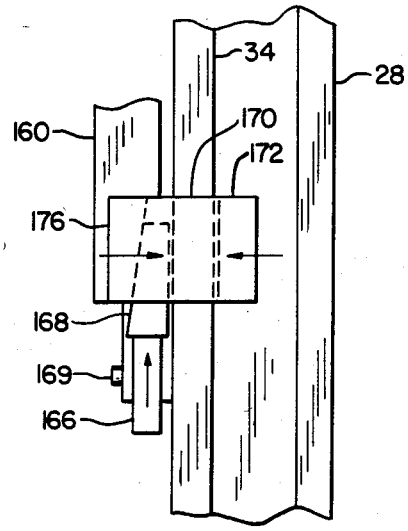

ELEVATOR

FIELD OF INVENTION

This invention relates to elevators and primarily to convenience elevators used in homes and commercial establishments for transporting articles between floors such as fireplace wood, laundry, food and drink, groceries, etc. It may also be used for limited passenger transportation.

BACKGROUND OF INVENTION

Elevators such as contemplated herein are not the commonly referred to elevators found in high-rise buildings used to rapidly transport passengers up and down between floors. The present elevator is a conveniance elevator, used primarily to carry goods up and down between two, three or perhaps four floors. For example, a residence built into the side of a hill may have a fireplace and kitchen on a level two stories above the garage. The home owner will have to carry fireplace wood and groceries to upper level. Due to health, age or simply a desire for convenience, the owner may have a convenience elevator built into his home to carry these items up and down the floors.

An elevator having specific use for transporting articles such as described above, is sometimes referred to in the industry as a dumbwaiter. These elevators generally have a load capacity rating in the range of 4–500 lbs. The current convenience elevator additionally contemplates the larger residential elevators having a load capacity rating in the range of 700 lbs. which can be used to transport a single person up and down several floors e.g. a person confined to a wheel chair.

Heretofor convenience elevators were generally comprised of a shaft or opening extending between floors, a carriage that fits the lateral dimensions of the shaft and designed to travel up and down in the shaft, and a power unit at the top or bottom of the shaft having a cable connected to the carriage to lift and lower the carriage. Because these elevators are primarily for convenience, the cost of installation is a major concern. The home owner simply cannot justify the convenience of the elevator if the cost of installation is many thousands of dollars. Thus many of the technical advances developed for passenger elevators are not applicable to convenience elevators.

In an effort to contain the cost of convenience elevators, a number of design features have been adopted resulting in undesirable characteristics heretofor considered inherent in convenience elevator design. A number of characteristics are described below:

The mounting for the convenience elevator is generally achieved by providing a load bearing beam over the top of the shaft. In that the usual home is not designed to provide these load bearing beams, it is often necessary to reconstruct a major segment of the ceiling structure. Unless done properly at a substantial cost to the home owner, the strength of the ceiling structure may be compromised.

The support for prior convenience elevators have been largely unitized and generally require installation prior to closing in the roof and ceiling. Installation for such structures after construction of the home is completed is a costly operation.

The lateral shaft dimensions for a convenience elevator is often very small and very difficult for even a single person to work in. Thus substantial pre-assembly is generally considered a necessity.

Isolation of vibration from the elevator's moving component is difficult to achieve at budget level cost and noise is a problem. Many home owners are reluctant to accept the noise levels that must be tolerated for low cost convenience elevators.

Many of the design characteristics available for passenger elevators for improved operation, repair and maintenance is too costly to install in convenience elevators. However, the failure to provide these features renders convenience elevators very costly to maintain.

SUMMARY OF INVENTION

The present invention encompasses a combination of design features that largly obviate the dissadvantages of prior conveniance elevators.

The design of the present elevator provides for a mounting that does not rely on overhead support beams. Rigid crosspieces which serve as guide rail wall supports are fastened to one side wall at desired spacings from the bottom to the top of the shaft. Guide rails having a configured H cross-section (to thereby define opposed channels) are fastened to the wall supports. The power unit is attached to the uppermost wall supports and the entire weight of the system is carried on the selected wall through attachment to the numerous wall supports. The manner of attachment, to be explained in the detailed section hereafter, enables the installer to work in the close confines of the elevator shaft.

Whereas rollers supporting the carriage produce considerable vibration noise and are expensive to install and maintain, the present invention incorporates sliding guides that are guided in the channels of the guide rail. The guide rail channels are further configured to provide bearing guide surfaces that allow the guides to slide easily and relatively noiselessly.

The power unit is mounted to the wall supports by a mounting bracket that includes rubber isolators to minimize vibration noise of the power unit being transmitted to the wall. The drive system includes a double loop arrangement that allows for disengagement of the power unit for repair while securing the relative position of the carriage and counter weight (thus reducing a major problem in maintenance). The power unit is provided with an automatic shutoff switch activated when the clutch slips, and an idler support brake control is provided in an alternate embodiment to provide additional safety.

DETAILED DESCRIPTION AND DRAWING

This invention will be more clearly understood and appreciated by reference to the following detailed description and drawings wherein:

FIG. 6 is a schematic view of a safety stop mechanism for the elevator;

FIG. 7 is a view taken on lines 7—7 of FIG. 6;

FIG. 8 is a view taken on view lines 8—8 of FIG. 7; and

THE MOUNTING SYSTEM

Figure 1:
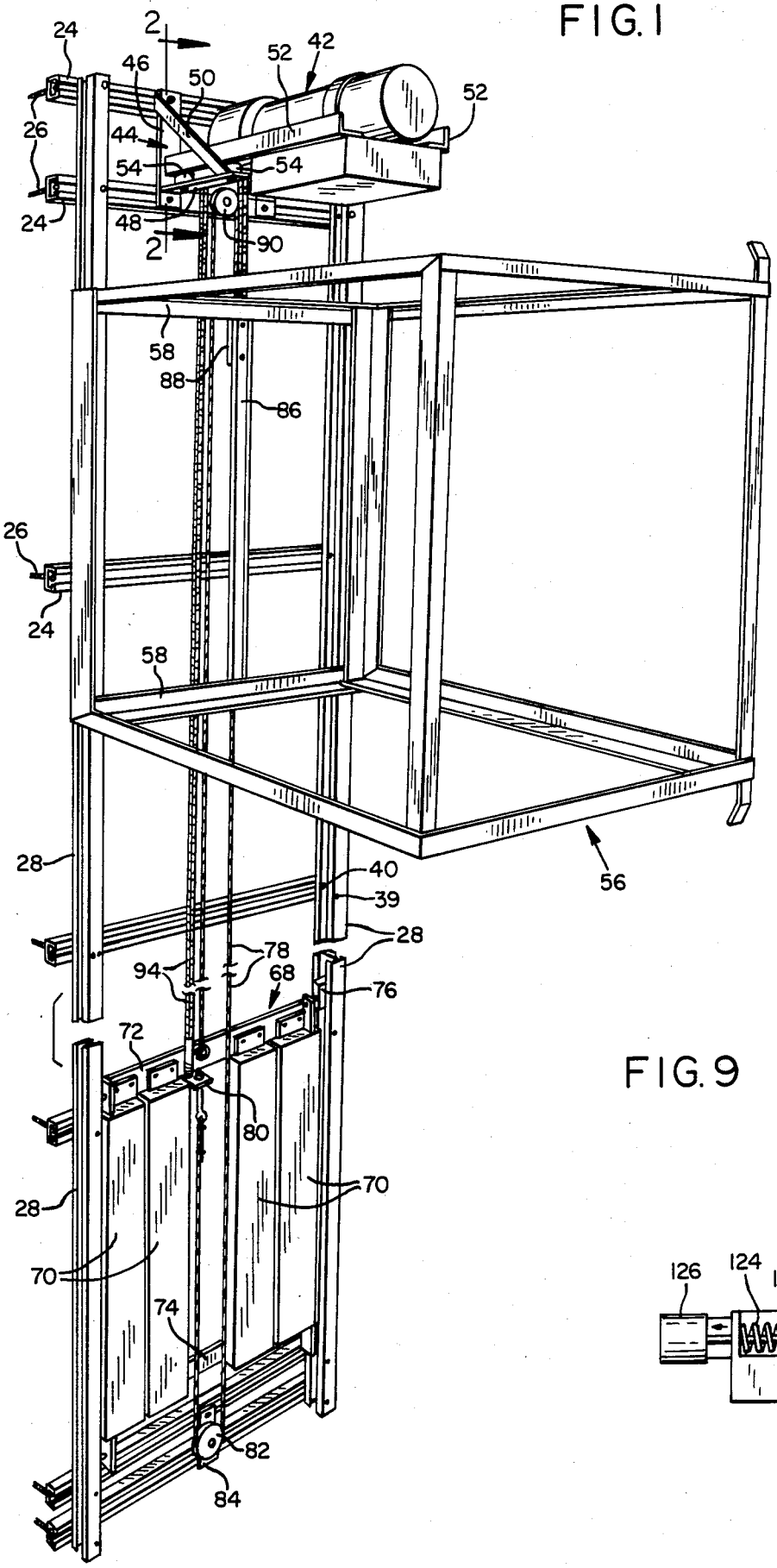
FIG. 1 is a schematic illustration of a convenience elevator in accordance with the invention.

The elevators mounting system is generally illustrated in FIGS. 1–4. It will be understood that the structure illustrated is designed for mounting in a shaft defined by four walls 20 (not shown in FIG. 1 but shown in segments in FIGS. 2 and 3), which are supported by upright 2×4 studs 22 generally located at the four corners of the shaft as illustrated. (Not illustrated are the intermediate studs that are generally located at 16 inch centers.) One of these walls 20 is selected to be the load bearing wall for the entire elevator structure as will now be explained.

Whereas the shaft dimensions will vary both in lateral dimension and height, for purposes of this description, the dimensions assumed will be 36 inches for each lateral dimension and a height of 25 feet. Rigid C shaped wall supports 24 are cut into crosspiece sections of just under 36 inches in length to fit the width of the selected wall. Holes are drilled adjacent each end to accomodate 5/16 inch lag screws 26. The holes are positioned in the wall supports 24 so that the lag screws 26 will penetrate through the walls 20 (generally wall board) and into the upright studs 22 to insure a secure fastening of the wall supports to the wall.

Whereas the spacing of the wall supports 24 on the wall 20 may be varied depending on such things as the weight rating of the carriage, a typical structure will include two closely spaced wall supports 24 at both the bottom and top of the shaft and otherwise at about 3 ft. intervals. Thus about 10 wall supports 24 will normally be adequate for the 25 ft. shaft height. This provides a total of 20 lag screws that secure the structure into the 2×4 stud.

Figure 2:
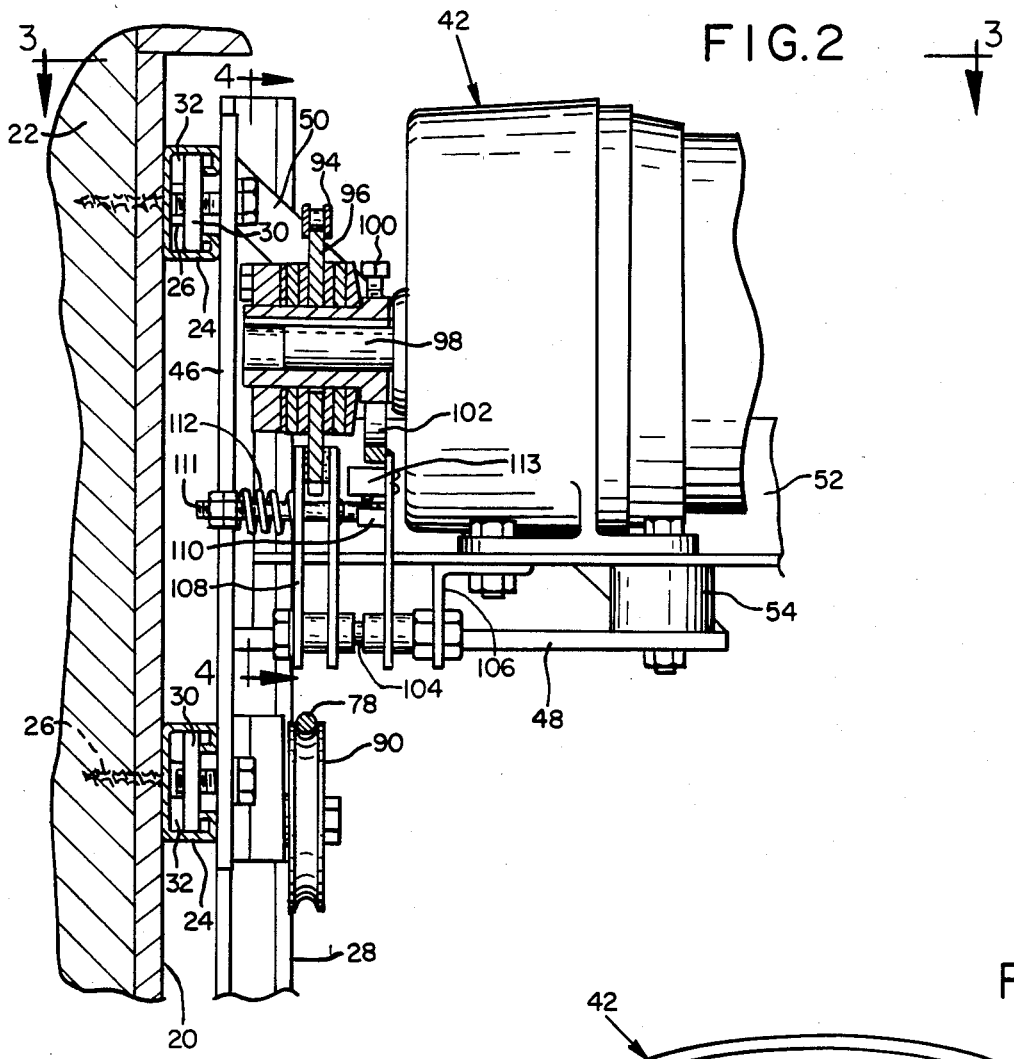
FIG. 2 is partial view of the power unit and mounting structure taken on view lines 2—2 of FIG. 1.

Vertical guide rails 28 are fastened to the wall supports 24. As shown in FIG. 2, elongated inserts 30, sized to fit the channel 32 defined by the C section wall supports, are slidably carried in channel 32, having been placed there prior to fastening the wall supports 24 to the wall. These inserts are trapped in the channel but can be slid back and forth for positioning. The inserts are provided with a threaded hole. The guide rails 28 have an H shaped cross section (see FIG. 3) with the ends folded inwardly (actually double folded) to define inner and outer opposed guide channels 33 and 35 bounded by guide bearing surfaces 34, 36 and the web 37.

Figure 3:
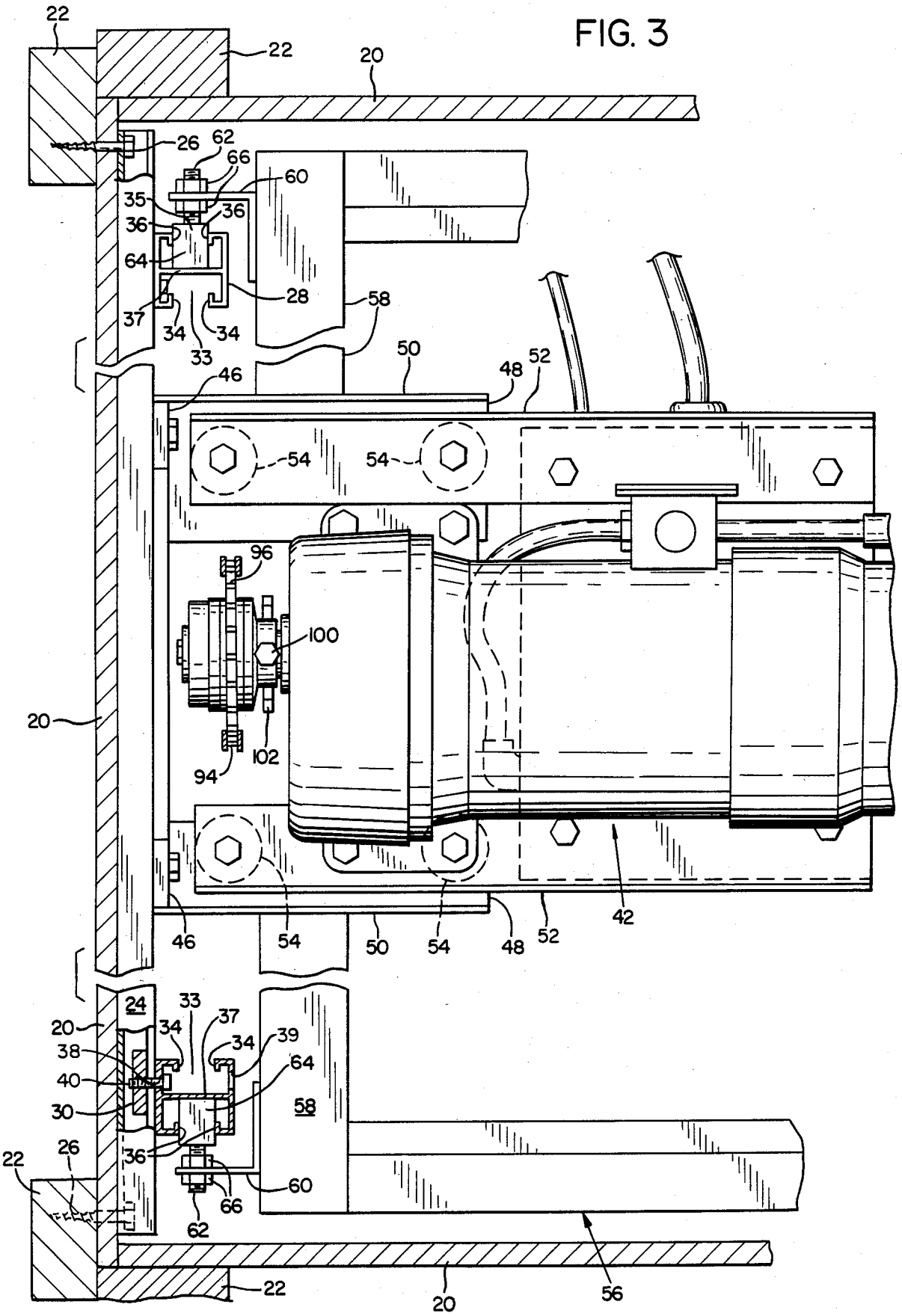
FIG. 3 is top view of the power unit and mounting structure as taken on view lines 3—3 of FIG. 2.

One pair of the legs of the H shaped guide rail 28 (the inwardly directed legs as seen in the guide rail at the bottom of FIG. 3) is provided with aligned openings 38 and 39. Opening 38 receives an allen headed bolt 40 that is designed to be screwed into the threaded hole of the insert 30. Hole 39 permits insertion of an allen wrench for engagement with the head of bolt 40. Note from FIG. 3 that the head of the bolt 40 is inset from the guide bearing surface 34, and thus outside of the channel defined by the guide bearing surfaces.

In assembling the structure, the assembler determines the positions of the wall supports 24 relative to the vertical guide rails 28 and assembles them together as permitted by reaching up from the bottom openings and down from the top openings of the shaft. The ladder like structure is then abutted against the wall and the lag screws are screwed into the corner studs. The resulting structure can then be used by the assembler for ascending and descending the elevator shaft as required for the final assembly steps.

The power unit 42 is mounted to the top two of the wall supports 24. A pair of triangular supports 44 each includes an upright rigid metal strap 46 securely bolted at each end to the top two wall supports 24 (again using the inserts 30 with threaded holes). A metal support bar 48 is attached to the lower end of strap 46 and projected outwardly therefrom, a rigid cross bar 50 extends from the top of strap 46 to the projected end of support bar 48 to provide a secure lateral support for the power unit. The power unit 42, including all its components, is mounted on a pair of support rails 52 that are spaced to coincide with the spacing of the support bars. Support rails 52 are secured to the support bars 48 through four rubber isolators 54 (two on each rail) to minimize the transfer of vibration from the power unit to the wall supports 24 and walls 20.

As best seen in FIG. 1, carriage 56 is illustrated as a frame only. Walls, flooring and ceiling are of course provided in the finished carriage structure. In general, the carriage comprises a box like structure having sufficient strength to be suspended from braces 58 provided at the rear of the carriage. As specifically shown in FIG. 3, L shaped brackets 60 are fastened to the brace 58, as by welding, at each of the four corners at the back of the carriage. The projected leg of the bracket 60 has a hole drilled through it that receives a threaded stud 62 that carries, at its opposite end, a guide 64. The guide 64 is designed to fit the channel 35 defined by guide bearing surfaces 36 and web 37, and to slide up and down therein. The guide is constructed of a high strength low friction polymer. Securing nuts 66 are provided to adjust the guide 64 to fit the channel and to securly lock that position relative to the bracket 60. With the carrage 56 thus mounted to the guide rails 28, it is free to slide up and down on the rails within the shaft.

Figure 5:
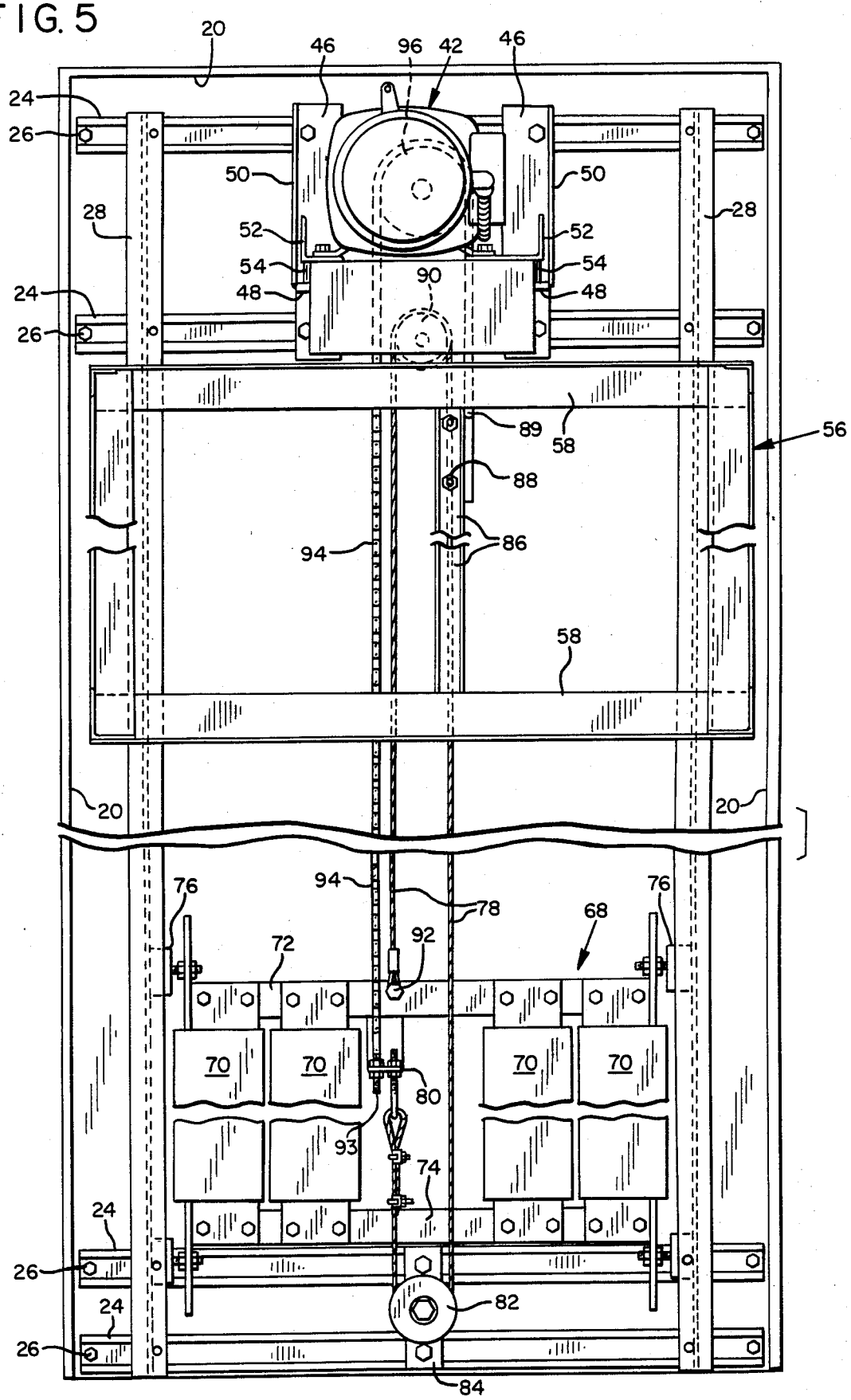
FIG. 5 is a front view illustrating the drive system for the elevator.

Reference is now made to the counter weight structure 68 which is also mounted to the guide rails 28 (see FIGS. 1 and 5). Four weights 70 are fastened to top and bottom cross bars 72 and 74 respectively. Guides 76, similar to guides 64, are mounted at each side of the cross bars 72 and 74 and are designed to fit the guide channels 33 of guide rails 28. Thus the counter weight structure 68 is captured between the guide rails and adapted to slide up and down the guide rails without interference of the carriage 56, which is spaced outwardly from the guide rails by the L shaped brackets 60.

The drive mechanism interlinking the power unit 42 with the carriage 56 and counter weight structure 68 will now be explained. Referring to FIGS. 1 and 5, a wire rope or cable 78 is anchored to the counter weight structure 68 at anchor point 80. The cable extends downwardly therefrom and passes around an idler wheel 82 fixed to a bracket 84 that is fastened to the lower two wall supports 24. The cable 78 then extends upwardly to the carriage 56 where it is fixed to verticle standard 86 at a second anchor point 88. The cable continues upward to a second idler wheel 90 that is mounted to an upper wall support (the lower of the top two wall supports). The cable then extends downwardly to the counter weight structure where it is anchored thereto at anchor point 92. The structure just described fixes the relative positions of the counter weight structure and the carriage but not for driving the cable which will now be described.

A drive chain 94 is anchored to the standard 86 of the carriage 56 at anchor point 89. The chain extends upwardly to a drive sprocket 96 driven by the output shaft 98 of the power unit. The chain engages the sprocket teeth of the drive sprocket 96 and extends downwardly therefrom to the counter weight structure 68 where it is anchored to the counter weight structure at anchor point 93.

It will be appreciated that the turning of the drive sprocket pulls one side or the other of the chain to raise or lower the carriage. The cable 78 maintains the relative position of the carriage and counterweight structure independent of the drive chain and when maintenance of the power unit is required, the chain can be simply disconnected from the sprocket without altering the relationship between the carriage and counter weight structure.

THE POWER UNIT

Figure 4:
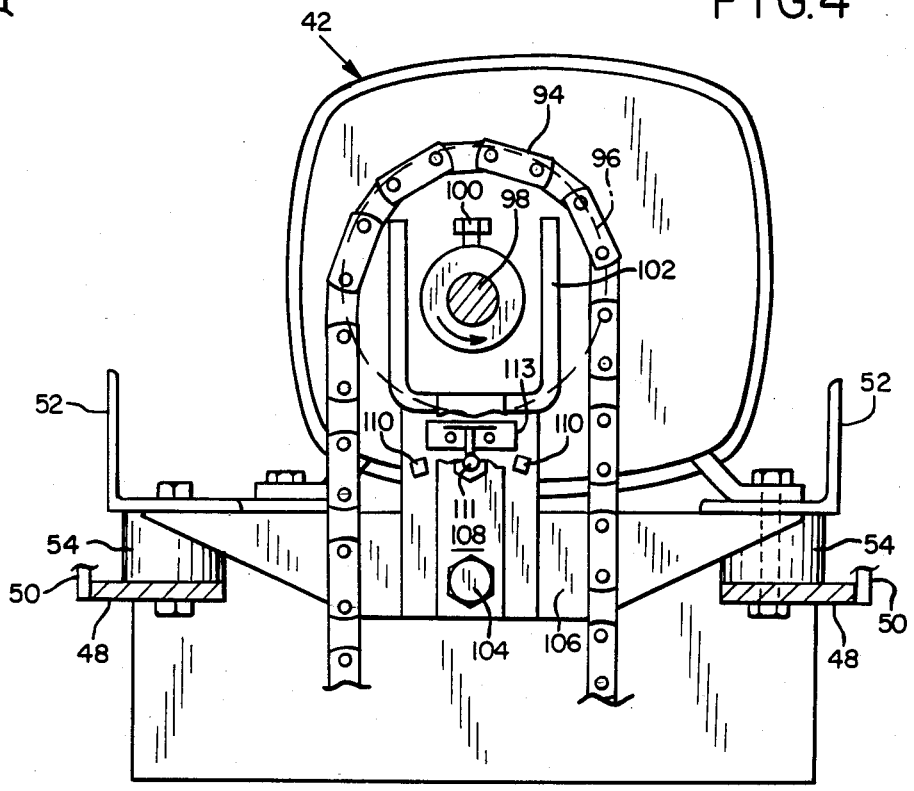
FIG. 4 is a rear view of the power unit and mounting therefor as taken on view lines 4—4 of FIG. 2.

The power unit 42 comprising the gear motor and brake are standard and it will suffice to say that the power rating must be matched to the load demands and also should be structured to mount within the dimensions of the elevator shaft. Whereas the preferred motor for transporting articles is provided with a slip clutch arrangement between the drive shaft and drive sprocket, it is desirable to provide a shutoff switch so as to avoid long periods of slipping as when the carriage is overloaded. The present elevator is provided with a shut-off mechanism which is illustrated in FIGS. 2, 3 and 4.

A screw 100 is screwed into the drive shaft 98 and the head of the screw protrudes from the shaft as shown. Surrounding the shaft and screw is a yoke 102 that is pivoted below the shaft at pivot point 104 on a cross brace 106 of the power unit mounting. A lever 108 is also pivoted to pivot 104 and pivotong thereof is controled by yoke 102 acting through pin 111 which engages stops 110 carried by the yoke 102. Lever 108 is held in frictional engagement with the drive sprocket 96, by the spring 112 surround pin 111. As the drive sprocket 96 rotates, as illustrated by the arrows in FIG. 4, the frictional engagement of the sprocket with the lever 108, moves the lever into engagement with stop 110 and out of engagement with switch 113 which is normally closed. The power unit can continue to run as long as the switch 113 is closed. Once the contact is broken, the power unit shuts off and a new start cycle is required to initiate movement of the switch to again engage one of the stops.

The yoke 102 pivots back and forth by reason of the screw head 100 (acting as a cam member) engaging first one arm and then the other of the yoke (acting as a cam follower). Regardless of this oscilation, lever 108 remains in contact with stop 110 due to frictional urging of the sprocket, as long as the sprocket turns with the drive shaft. Should the sprocket start to slip, the lever 108 is first forced to the left as seen in FIG. 3, by the oscillation of the yoke 102 acting through stop 110, and it is held in that position by the frictional engagement with the now stationary sprocket 96. As the yoke returns to the right side of the drive shaft, the lever 108 engages switch 113 to open the switch off the motor.

SAFETY BRAKE

FIGS. 6, 7, and 8 schematically illustrate the safety brake incorporated into the carriage 56. The drive chain 94 is anchored to a bolt 158 that protrudes through a brace 160 of the carriage. Whereas the tension in the chain 94 pulls the head 162 of the bolt 158 toward the brace 160, a spring 164 urges the bolt 158 downwardly. A cross member 166 is connected to the bolt head 162 and is pivoted at 169 to the brace 160. The end 168 of the cross member 166 is wedge shaped as seen in FIG. 8. A clamp member 170 extends from brace 160 around the guide rail 28 with a clamp end member 172 projected into the guide channel 35. A frictioal gripping surface 174 an end member 172 is adapted to engage guide bearing surface 34 of the channel. A neck portion 176 of clamp member 172 is wedge shaped as viewed in FIG. 8. The wedged shaped end 168 of arm 166 is positioned to slidably engage the wedged shaped neck portion of the clamp member. Should chain 94 loosen or break, spring 164 urges pivoting of arm 166 whereby end 168 engages neck portion 176 and is cammed thereby to initiate clamping pressure against the guide rail 28. With the carriage dropping and with the frictional engagement of surface 178 against the guide rail resisting downward movement, the resulting wedging action between the neck portion and end 168 forces ends 168 and 172 tighter and tighter against the rail to effectively lock the elevator against downard movement.

ALTERNATE EMBODIMENTS-IDLER BRAKE

Figure 9:
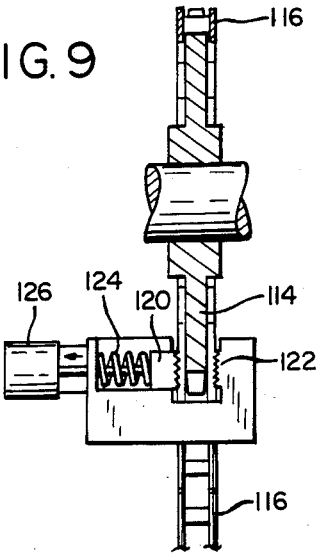
FIG. 9 illustrates a safety brake for the idler wheel in an alternate embodiment of the invention.

FIG. 9 illustrates a variation to the embodiment shown and is primarily directed to residential elevators wherein additional safety features are desirable. Thus the idler wheel 90 of FIG. 2 is replaced with an idler sprocket 114 and the cable 78 (or at least the upper section of the cable 78) is replaced with a chain 116. A solenoid operated brake of conventional design is positioned to clamp the strocket between clamping elements 120 and 122. The clamping elements are urged together by spring 124 and are held apart by solenoid 126. On the occurrance of a power shut down, solenoid 126 is released and spring 124 urges clamping of the sprocket. It will be understood that in typical fashion, the clamping elements are designed to be wedged against the sprocket to securely lock the sprocket against further turning. This electrical shut off and braking of the idler sprocket, as well as a shut down of the power unit, is induced by any electrical failure that occurs when a switch is opened. Accordingly, switches are provided to be opened should either of the chains break, or a door is opened, or a stop button is pushed, etc.

The alternate embodiment just described is provided generally for a heavier residential elevator e.g. rated at 700 lbs. as opposed to the 4–500 lb. elevator described in FIGS. 1–8. It will also be appreciated that the elevator can be simplified for lower weight ratings e.g. for a 200 lb. elevator. In such an embodiment, the counter weight structure can be eliminated and the guide rails, which then require only a single guide channel, may be C shaped. These and other variations and modifications will be apparent to those skilled in the art and such variations are encompassed within the scope of the invention as defined by the claims appended hereto.

I claim:

1. A convenience elevator mounted in a shaft having a support wall comprising: wall supports mounted crossways on said support wall at spaced intervals from the bottom to the top of the shaft, said wall supports structured to define C shaped channels having inturned edges, inserts having threaded openings slidably received in said channels that are prevented from removal by the inturned edges, vertical guide rails mounted to the wall supports and extending from the bottom to the top of the shaft, said vertical guide rails mounted to the wall supports by bolts screwed through the sides of the guide rails into the threaded openings of said inserts, said vertical guide rails configured to form guide channels, a carriage adapted for ascending and descending within the shaft, guide brackets mounted to the carriage, guides carried by the brackets and protruded into the guide channels, said vertical guide rail guide channels having inturned edges that define guide bearing surfaces that engage the sliding guides and space the guides inwardly of the channel sides thereby providing clearance for the bolt heads of the bolts screwed through the guide rail sides, and drive means including a power unit for controllably driving the carriage up and down within the shaft as permitted by the guides slidably ascending and descending within the guide channels of the guide rails.

2. A convenience elevator as defined in claim 1 wherein said guides are sliding guides produced from a high strength, low friction material.

3. A convenience elevator as defined in claim 2 wherein said guide brackets include adjustment means to adjust the positions of the sliding guides within the guide channels.

4. A convenience elevator mounted in a shaft having a support wall comprising; wall supports mounted crossways on said support wall at spaced intervals from the bottom to the top of the shaft, vertical guide rails mounted to the wall supports and extending from the bottom to the top of the shaft, said vertical guide rails configured to form guide channels, a carriage adapted for ascending and descending within the shaft, guide brackets mounted to the carriage, guides carried by the brackets and protruded into the guide channels, said guide rails are H shaped to define back to back C section channels having inturned edges that define guide bearing surfaces, said vertical guide rails being guide rails each oriented with a guide channel opening inwardly towards the opposite guide rail and a guide channel opening outwardly therefrom, said carriage having a pair of guide brackets mounted for locating the sliding guides in the two outwardly facing guide openings, a counter weight structure mounted for ascending and descending within the shaft between the pair of vertical guide rails, and sliding guides carried by said counter weight structure and positioned to slide up and down within the inwardly facing channel openings, and drive means including a power unit for controllably driving the carriage up and down within the shaft as permitted by the guides slidably ascending and descending within the guide channels of the guide rails.

5. A convenience elevator mounted in a shaft having a support wall comprising; a first idler wheel being a sprocket mounted to the wall adjacent the top of the shaft and a second idler wheel mounted to the wall adjacent the bottom of the shaft, and a first guide line section of interconnected chain links extended upwardly from the carriage around the idler sprocket and downwardly therefrom to the counter weight structure, and a second guide line section extending downwardly from the carriage around the second idler wheel and upwardly therefrom to the counter weight structure, said guide line sections being each securely attached to both the carriage and the counter weight structure forming a taut continuous loop that secures the relative positions of the carriage and counter weight structure within the loop, and a separate drive line attached to the carriage and the counter weight structure, a drive shaft driven by the power unit and a drive wheel driven by said drive shaft, and said drive line looped over the drive wheel for raising and lowering the carriage and counter weight structure, and a solenoid operated disk brake mounted to the sprocket, said brake including means to initiate engagement and braking of the idler sprocket upon loss of electrical power to the solenoid, sensing switches that sense predetermined conditions where elevator braking is desireable, said sensory switches connected to the power input of the solenoid to shut off the power upon occurrence of a said predetermined condition.

6. A convenience elevator mounted in a shaft having a support wall comprising; a carriage adapted for ascending and descending within the shaft, and drive means including a power unit for controllably driving the carriage up and down within the shaft, said power unit being electrically driven, a drive shaft driven by said power unit, a drive sprocket mounted to the drive shaft and slip clutch means that permits the sprocket to slip on the drive shaft when overloaded, a yoke member pivotally mounted to the power unit having a pair of arms extended on opposite sides of the drive shaft adjacent the drive sprocket, a protrusion on the drive shaft adapted to engage the arm of the yoke member to pivot the yoke member from side to side as the drive shaft rotates, a lever pivotally mounted adjacent the yoke member and a stop that limits the pivotal movement of the lever in one direction, a switch that is normally closed and engageable by the lever to be thereby opened when the lever is pivoted away from the stop, said lever having frictional engagement with the drive sprocket whereby the lever is urged toward the stop as the drive sprocket rotates and is urged away from the stop and towards the switch when the drive sprocket slips on the drive shaft.

* * * * *